United States Patent [19]

Curwen et al.

[11] Patent Number: 4,836,757

[45] Date of Patent: Jun. 6, 1989

[54] PRESSURE ACTUATED MOVABLE HEAD FOR A RESONANT RECIPROCATING COMPRESSOR BALANCE CHAMBER

[75] Inventors: Peter W. Curwen, Ballston Spa; Ralph Hurst, Clifton Park, both of N.Y.

[73] Assignee: Mechanical Technology Incorporated, Latham, N.Y.

[21] Appl. No.: 206,220

[22] Filed: Jun. 13, 1988

Related U.S. Application Data

[63] Continuation-in-part of Ser. No. 14,444, Feb. 13, 1987, Pat. No. 4,750,870.

[51] Int. Cl.[4] ..... F04B 31/00

[52] U.S. Cl. ..... 417/416; 417/340; 92/133; 92/134

[58] Field of Search ..... 417/11, 415, 416, 340; 92/133, 134; 123/46 R

[56] References Cited

U.S. PATENT DOCUMENTS

| | | | |
|---|---|---|---|
| 2,461,225 | 2/1949 | Meitzler | 417/274 X |
| 2,761,615 | 9/1956 | Prince | 417/274 X |
| 2,853,982 | 9/1958 | Bachle et al. | 417/340 |
| 3,524,436 | 8/1970 | Braun | 123/46 R |
| 4,167,922 | 9/1979 | Doundoulakis | 123/46 R |
| 4,353,220 | 10/1982 | Curwen et al. | 417/416 X |
| 4,433,279 | 2/1984 | Bhate | 310/15 X |
| 4,488,853 | 12/1984 | Benson | 417/340 X |
| 4,576,011 | 3/1986 | Glamm et al. | 62/324.6 X |

*Primary Examiner*—Carlton R. Croyle
*Assistant Examiner*—Eugene L. Szczecina, Jr.
*Attorney, Agent, or Firm*—Joseph V. Claeys; Joseph C. Sullivan

[57] ABSTRACT

The present invention relates to a resonant piston compressor in which a double-sided piston reciprocates within a cylinder and defines a valved compression space on one side of the piston and a balance chamber on its other side. The invention further includes a movable head adjustable between first and second positions to effect a large change in the total volume of the balance chamber between the two positions. In one position, of the movable head an extended balance chamber volume is coupled to the balanced chamber while in the other position of the movable head, the extended balance chamber volume is decoupled from the balance chamber.

12 Claims, 1 Drawing Sheet

PRESSURE ACTUATED MOVABLE HEAD FOR A RESONANT RECIPROCATING COMPRESSOR BALANCE CHAMBER

This application is a continuation-in-part of co-pending application Ser. No. 014,444, filed Feb. 13, 1987, now U.S. Pat. No. 4,750,870.

TECHNICAL FIELD

The present invention relates to resonant reciprocating compressors and more particularly to arrangements for providing a pressure actuated movable head for the balance chamber of such compressors.

BACKGROUND ART

There exists a class of machinery which utilizes mechanical resonance as the means to obtain periodic motion of the machine's elements. For convenience, the resonant machine of this invention will be referred to as a Resonant Piston Compressor (RPC). The RPC is a reciprocating compressor which falls into this class of machinery and which can be utilized in various compressor applications, such as for example electrically-driven heat pumps. Generally, an RPC is comprised of an electrodynamic motor which drives a reciprocating piston and thereby provides the compression action on a working fluid which may be a gas or a liquid.

In known free piston resonant reciprocating compressors the fluid compressing member, such as a piston, is driven by a suitable motor, such as a linear reciprocating electrodynamic motor. A compression piston is usually coupled to the motor armature and the armature is held in a rest position by way of one or more main or resonance springs. When the motor is energized, such as by an alternating current, a magnetic force is generated to drive the piston and the resonance spring causes the piston to oscillate back and forth to provide compression of the fluid.

It is desirable to provide an RPC which operates over a broad range of suction and discharge pressures such as that which occurs in a residential heat pump.

The advantage of the RPC in such an application is that variable capacity heat pump operation can be achieved by modulating the RPC's piston stroke. In conventional heat pumps, variable capacity operation is generally achieved by modulating speed of the compressor by varying the electrical frequency supplied to the compressor motor. However, the cost of the solid-state electronic components required to achieve a variable frequency motor drive would be appreciably higher than the cost of the components needed for a fixed-frequency variable current drive for a modulating RPC.

Unfortunately, the heat pump application does not have a fixed design-point condition. The compressor inlet and discharge pressures change with changes in outdoor temperature. For example, at an outdoor temperature of 95° F., the compressor inlet and discharge pressures for R-22 refrigerant will typically be 90 and 300 psia, while on a 15° F. day the inlet and discharge pressures will typically drop to 37 and 200 psia, respectively. As a result of this variation in pressures, there is a significant variation in the "gas-spring stiffness" of both the compressor and the balance chamber with outdoor temperature. This in turn causes a significant variation in resonant tuning of the RPC to the point where satisfactory operation of the RPC is not possible at one or the other outdoor temperature extreme.

For example, in the case of a 2½ ton rated compressor, the following table shows the variation in compressor and balance cylinder stiffness for outdoor temperatures of 95° F. and 12° F.

| Outdoor Temperature (°F.) | Stiffness (lbf/in) Compressor Cylinder | Balance Cylinder | Total Stiffness |
|---|---|---|---|
| 95 | 1735 | 228 | 1963 |
| 12 | 1019 | 126 | 1145 |

There is roughly a 40 percent reduction in total stiffness at the 12° F. outdoor temperature condition compared to the 95° F. condition. This is too great a reduction for a fixed frequency, resonantly operating RPC.

More particularly, for a plunger of 6 pounds, and a natural frequency of 60 Hertz, the required gas-spring stiffness of the unit is approximately 2000 lbf/in. During air-conditioning operation on a 95° F. day, approximately 90 percent of this required stiffness is supplied by the compression chamber. The remaining 10 percent must be supplied by the balance chamber. However, during heating operation on a 12° F. day, the compression chamber will provide only 60 percent of the required stiffness due to the reduced pressure level of the R-22 refrigerant cycle. The remaining 40 percent must be supplied by the balance chamber. However, for the same reason that stiffness of the compression chamber is reduced on a 12° F. day, also so will the stiffness of the balance chamber be reduced unless some other means is available to counter this reduction.

In co-pending patent application Ser. No. 014,444, filed Feb. 13, 1987, and assigned to the same assignee as the present invention, there is described and claimed an improved resonant piston reciprocating compressor which operates over a broad range of suction and discharge pressures such as occurs in a residential heat pump application, for example.

In the arrangement described and claimed in the foregoing patent application the effect of reduced gas spring stiffness during the heating mode of operation is countered by providing means associated with the balance chamber for changing the total balance chamber volume between the heating and cooling modes of operation. In one arrangement of the foregoing patent application a double-sided piston means reciprocates within a cylinder and defines a valved compression space on one side of the piston means and a balance chamber on the other side thereof. The arrangement includes a movable head means adjustable between first and second positions to effect a large change in the total volume of the balance chamber between the two positions. That is, in one position of the movable head, an extended balance chamber volume is coupled to the balance chamber while in the other position of the movable head the extended balance chamber volume is decoupled from the balance chamber.

As further background the disclosure of the foregoing referenced patent application is incorporated herein by reference.

DISCLOSURE OF INVENTION

It is an object of this invention to provide an improved resonant piston compressor for use in a variety of applications, such as in particular, a heat pump application, and having an improved means of changing the total volume of the balance chamber for selective operation in the heating and cooling modes.

Briefly stated, in accordance with one aspect of the invention there is provided a new and improved movable head for a resonant piston compressor of the type wherein a double-sided piston means defines a valved compression space on one side of the piston means and a balance chamber volume on the other side thereof. The resonant piston compressor also includes means for adjusting the position of a movable head means of the balance chamber volume so as to vary the total balance chamber volume between a first position at which an extended balance chamber volume is decoupled from the balance chamber and a second position at which the extended balance chamber volume is coupled with the balance chamber.

BRIEF DESCRIPTION OF THE DRAWINGS

The aforenoted objects and advantages and others will be realized by the present invention, the description of which should be taken in conjunction with the drawings wherein.

BEST MODE FOR CARRYING OUT THE INVENTION

Figure 1:
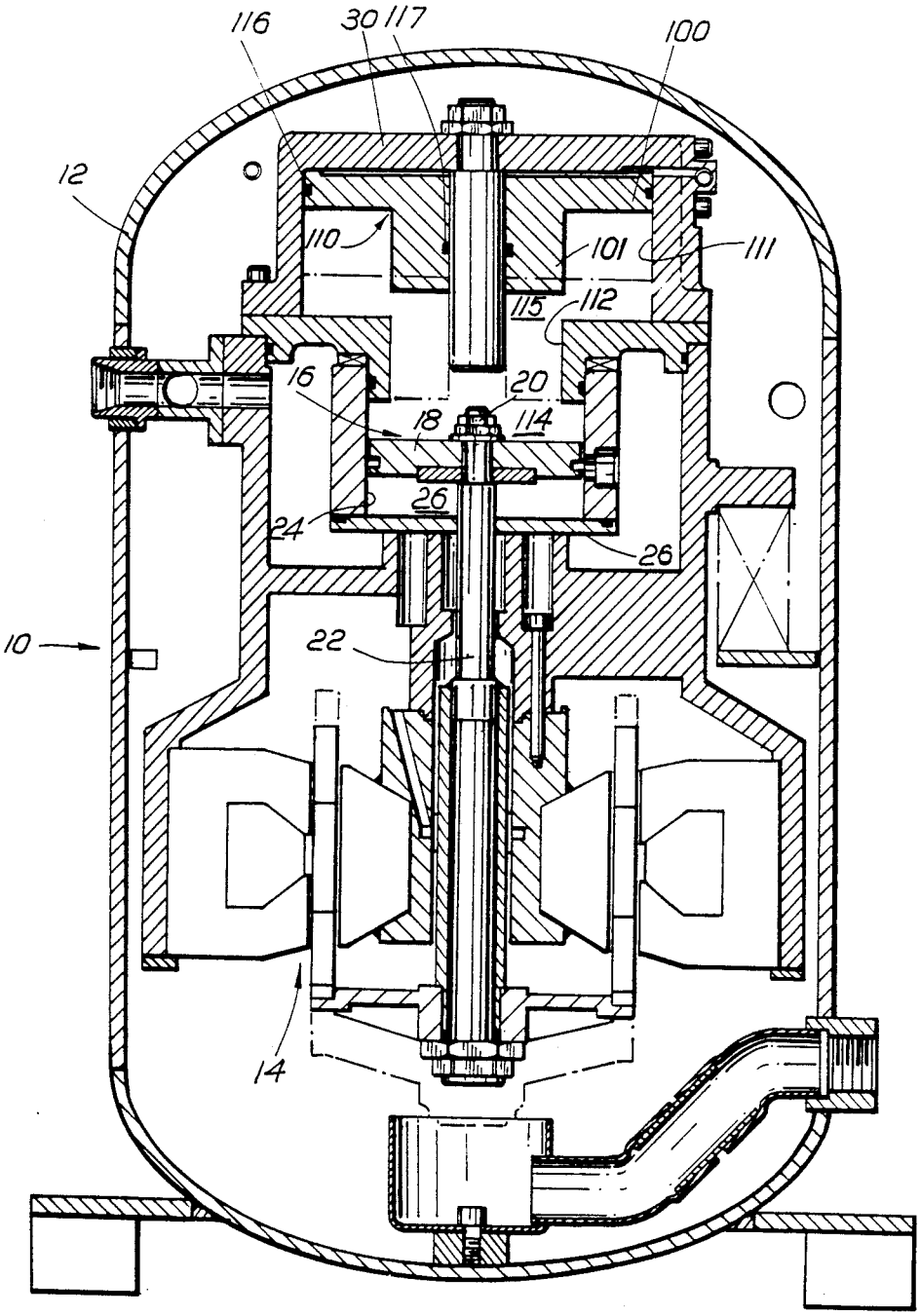
FIG. 1 is a sectional view of an RPC incorporating the new and improved movable head arrangement of the present invention.

With more particular regard to the drawing, there is shown a compressor 10. The compressor 10 includes an outer housing 12 which is cylindrical in shape containing an electrodynamic motor, generally indicated at 14, coupled to a double-sided piston assembly 16. In operation, when an alternating current is applied to the motor its magnetic plunger is caused to drive the compression piston in a first direction compressing the working fluid (such as air, helium, etc.). The current then alternates so that the plunger oscillates due to the reversed driving force by the motor. The motor operates typically on the order of 60 Hertz continuously compressing the working fluid.

Piston assembly 16 comprises a double-sided piston 18 which is mechanically affixed at 20 to a rod 22 which in turn is connected to the movable armature of motor 14. Piston 18 is positioned for reciprocation within a cylinder 24 which is closed at one end by a wall 26. Wall 26 is provided with suitable intake and discharge valve means (not shown) and defines with one side of the piston 18 a valved compression space. The other end of cylinder 24 is closed by a housing 30 which defines with the other side of piston 18 a balance chamber.

In accordance with this invention the RPC is provided with means for varying the stiffness exerted on the piston 18 by the balance chamber. To this end, a movable head means 110 is suitably disposed within the housing 30 and is arranged and constructed so that in one position of movable head means 110 the balance chamber consists of only a first volume, designated generally at 114. In another position of the movable head means 110 the balance chamber comprises the sum of the first volume 114 and also an extended volume 115.

As shown, more particularly in FIG. 1, housing 30 comprises two axially adjacent cylinders 111 and 112. Cylinder 111 is of a relatively large diameter located at one end of housing 30. Adjacent to cylinder 111 is another cylinder 112 of smaller diameter. Movable head means 110 has a first portion 100 arranged in a slidingly sealed relationship within the cylinder 111 and includes suitable seal means 116 and 117. Movable head means 110 also has a second portion 101 of smaller diameter and extending from first portion 100.

In one position of movable head means 110 the smaller diameter portion 101 is positioned within the cylinder 112. When movable head means 110 is in this position with portion 101 within cylinder 112 the total operating volume of the balance chamber comprises only the first volume 114. When the movable head means 110 is in the other position wherein the portion 101 is no longer within the cylinder 112, the total operating volume of the balance chamber comprises the sum of the two volumes 114 and 115. From the foregoing description it can be understood that in one position of the movable head means 110 wherein the smaller diameter portion 101 is disposed within the cylinder 112, the extended volume 115 is decoupled from the total balance chamber volume. On the other hand, when the movable head means 110 is in the other position wherein the smaller diameter portion 101 is no longer within the cylinder 112, the extended volume 115 is coupled with the volume 114 to provide a larger total balance chamber volume.

Aside from the coupling and decoupling action of the movable head 110, the other means for moving the head 110 is fully described in co-pending application Ser. No. 014,444 filed Feb. 13, 1987, which is scheduled to issue on June 14, 1988, as U.S. Pat. No. 4,750,870 and which is incorporated herein by reference.

Although only certain specific embodiments of the invention have been described in detail herein with reference where suitable to the accompanying drawing, it is to be understood that the invention is not limited to those specific embodiments and that various changes and modifications will occur to and be made by those skilled in the art. The appended claims, therefore, are intended to cover all such changes and modifications as fall within the true spirit and scope of the invention.

We claim:

1. In a resonant piston compressor wherein a double-sided piston means is arranged for reciprocation within a cylinder and defines a valved compression space on one side of the piston means and a balance chamber volume on the other side thereof including means for adjusting the position of a movable head means of the balance chamber so as to vary the total balance chamber volume between a first position at which an extended balance chamber volume is coupled with the balance chamber and a second position where said extended balance chamber volume is decoupled from said balance chamber to vary the "gas spring" stiffness exerted on the piston means by the total balance chamber volume during reciprocal movement of said piston means, the improvement comprising:

said movable head means having a first portion arranged to be slidingly sealed within said extended balance chamber and a second portion of smaller diameter extending from said first portion and arranged to be slidingly disposed within a corresponding cylinder portion of said balance chamber whereby when said second portion is disposed within said cylinder portion said extended balance chamber volume is decoupled from said total balance chamber volume and vice versa.

2. The invention in accordance with claim 1, wherein said adjusting means include valve means for varying the differential pressure across the movable head means so as to move it from the first to the second position and vice versa.

3. The invention in accordance with claim 2, wherein said compressor is used in a heat pump and said valve means comprises a heat pump reversing valve which adjusts said movable head means so as to be in the first position for air cooling operation and the second position for air heating operation.

4. The invention in accordance with claim 3, wherein said compressor is driven by a linear reciprocating electrodynamic motor.

5. The invention in accordance with claim 1, wherein said compressor is driven by a linear reciprocating electrodynamic motor.

6. A resonant piston compressor comprising:

cylinder means;

piston means disposed for reciprocal movement in said cylinder means;

valve means for providing suction and discharge flow control through said cylinder means;

said piston means in association with said cylinder means and said valve means defining a valved compression space on one side of said piston means and in further association with a housing means to define a balance chamber on the other side of said piston means;

an extended balance chamber volume defined by a relatively large cylinder means formed in said balance chamber;

a movable head means disposed in said balance chamber and being adjustable so as to vary the total balance chamber volume between a first head position at which said extended balance chamber volume is coupled to said balance chamber volume and a second head position where said extended balance chamber volume is decoupled from said balance chamber volume, which in turn varies the stiffness exerted on the piston means by the total balance volume during reciprocal movement of said piston means;

motor means for driving said piston means in said reciprocal movement; and adjusting means for adjusting said movable head means so as to vary the volume of the balance chamber.

7. The invention in accordance with claim 6, wherein said adjusting means include valve means for varying the differential pressure across the movable head means so as to move it from the first to the second position and vice versa.

8. The invention in accordance with claim 7, wherein said compressor is used in a heat pump and said valve means comprises a heat pump reversing valve which adjusts said movable head means so as to be in the first position for air cooling operation and the second position for air heating operating.

9. The invention in accordance with claim 8, wherein said motor means comprises a linear reciprocating electrodynamic motor.

10. The invention is accordance with claim 6, wherein said motor means comprises a linear reciprocating electrodyanmic motor.

11. In a resonant piston compressor including a balance chamber volume operatively associated with the reciprocating piston means of said compressor and having means for varying the "gas spring" stiffness exerted on said piston means by the balance chamber volume, the improvement comprising:

a balance chamber housing having formed therein a first cylinder means of relatively large diameter constituting an extended balance chamber volume, and a second smaller diameter cylinder means adjacent said first cylinder means;

a movable head means having a first portion slidingly sealed within said first cylinder means and a second smaller diameter portion extending from said first portion and adapted to be slidingly disposed within said second cylinder means; and means for selectively moving said movable head means between a first position wherein said second portion of said movable head means is positioned within said second cylinder means and said extended volume is decoupled from the total balance chamber volume and a second position wherein said second portion of said movable head means is not within said second cylinder means and said extended volume is coupled with the total balance chamber volume.

12. In a resonant piston compressor wherein a double-sided piston means is arranged for reciprocation within a cylinder and defines a valved compression space on one side of the piston means and a balance chamber volume on the other side thereof and including means for adjusting the position of a movable head means of the balance chamber volume so as to vary the total balance chamber volume between a first position at which an extended balance chamber volume is coupled with the balance chamber and a second position where said extended balance chamber volume is decoupled from said balance chamber to vary the "gas spring" stiffness exerted on the piston means by the total balance volume during reciprocal movement of said piston means, the improvement comprising:

said movable head means having a first portion arranged to be slidingly sealed within said extended balance chamber and a second portion of smaller diameter extending from said first portion and arranged to be slidingly disposed within a corresponding smaller diameter portion of said balance chamber whereby when said second portion is disposed within said smaller diameter portion said extended balance chamber volume is decoupled from said total balance chamber volume and when said second portion is not positioned within said smaller diameter portion said extended balance chamber volume is coupled with said total balance chamber volume.

* * * * *